US005188321A

United States Patent [19]

Hirschenson et al.

[11] Patent Number: 5,188,321

[45] Date of Patent: Feb. 23, 1993

[54] KEYBOARD STAND

[75] Inventors: Bernard Hirschenson; Joanna Hardin, both of New York, N.Y.

[73] Assignee: Compucube, Inc., New York, N.Y.

[21] Appl. No.: 732,791

[22] Filed: Jul. 19, 1991

[51] Int. Cl.[5] ..... A47B 21/00

[52] U.S. Cl. ..... 248/118; 248/918

[58] Field of Search ..... 248/118, 118.1, 118.3, 248/917, 918, 346; 400/715

[56] References Cited

U.S. PATENT DOCUMENTS

| | | | |
|---|---|---|---|
| 134,116 | 12/1872 | West | 248/118.1 |
| 3,123,935 | 3/1964 | Williams | 248/346 |
| 4,129,746 | 12/1978 | Lambden | 248/118.1 X |
| 4,570,803 | 2/1986 | Peterson | 248/118 X |
| 4,735,467 | 4/1988 | Wolters | 248/918 X |
| 4,776,284 | 10/1988 | McIntosh | 248/918 X |
| 4,913,390 | 4/1990 | Berke | 248/918 X |

*Primary Examiner*—Alvin C. Chin-Shue

*Attorney, Agent, or Firm*—Brumbaugh, Graves, Donohue & Raymond

[57] ABSTRACT

A keyboard stand comprises a substantially rigid plate-like member having an upper armrest surface of a size and shape such as to be adapted to support both forearms of a keyboard operator when the operator's hand are positioned to operate a keyboard and an upper keyboard-supporting surface of a size and shape such as to be adapted to support a keyboard. The upper keyboard-supporting surface is recessed below the upper armrest surface such the frontmost part of the housing of the keyboard does not extend substantially above the upper armrest surface.

3 Claims, 2 Drawing Sheets

KEYBOARD STAND

BACKGROUND OF THE INVENTION

Over a period of only about thirty years, computers have revolutionized vast areas of human endeavor. Computers can in seconds make computations that would have taken months or years to perform using mechanical calculators. Computers are now used almost universally for word-processing in the creation of information. Hug computer data bases are readily accessible by telephone modems for dissemination of information. Computer-controlled machines can perform numerous manufacturing operations more rapidly, reliably and accurately than their human-controlled predecessors. Exploration of space would not be possible without computers for controlling the complex systems of spacecraft. The benefits of computers to mankind are incalculable.

Present-day computers require extensive intervention of human operators at some point. The primary way of communicating with a computer is by the use of a keyboard. Programs have to be keyed in when they are created. Many forms of data are keyed in for processing. The creation of verbal material using a computer as a word-processor is a totally manual operation. Along with the vast benefits of computers has come, unfortunately, an increasingly serious problem encountered by many computer operators, a problem known as repetitive stress injury ("RSI"). Operating a keyboard requires repetitive flexing of the fingers. The tendons that flex the fingers and the median nerve pass through the carpel tunnel, which is a bundle of bones and ligaments. The synovial sheaths of the ligaments may become swollen as a result of overuse and can put pressure on the median nerve, which causes numbness and tingling of the arm and hand. Sitting at a keyboard for long periods of time, with the torso, arms and hands in the same position, puts considerable stress on the muscles and tendons of the back, shoulders, and arms. The stresses can be great enough to be debilitating, often requiring the victim to wear braces or splints. Sometimes, the stresses cause damage to muscles, tendons and other tissue of sufficient severity to require surgery. In addition the pain and suffering of those afflicted with the various forms of RSI, considerable economic losses result from employee absence and reduced productivity.

SUMMARY OF THE INVENTION

The object of the present invention is to reduce considerably the stresses imposed on the shoulder and arms of a keyboard operator and thereby minimize the possibility of the operator being subject to forms of RSI involving the shoulder and arms. That object is attained, in accordance with the present invention, by a keyboard stand comprising a substantially rigid plate-like member having a front edge, a rear edge, and side edges, an upper armrest surface of a size and shape such as to be adapted to support both forearms of a keyboard operator when the operator's hands are positioned to operate a keyboard, the upper armrest surface being bounded by the front edge and front parts of the side edges of the member, and an upper keyboard-supporting surface of a size and shape such as to be adapted to support a keyboard, the upper keyboard-supporting surface being bounded by the rear edge and rear parts of the side edges of the member and adjoining the upper armrest surface along a juncture at a location intermediate the front and rear edges of the member. The upper keyboard-supporting surface is recessed below the upper armrest surface such that the frontmost part of the housing of the keyboard does not extend substantially above the upper armrest surface. The member has a shoulder at the juncture between the armrest surface and the keyboard-supporting surface that is adapted to be engaged by the front edge of the keyboard housing.

In a preferred embodiment, the front edge of the member has a notched part shaped and positioned to receive an operator's lower front torso so that the operator's elbows, while resting on the armrest surface, may be positioned generally laterally of the lower torso with the upper arms in generally relaxed positions along the sides of the upper torso. The upper keyboard-supporting surface of the member is bounded by an upstanding flange defining, together with the shoulder at the juncture between the keyboard-supporting surface and the armrest surface, a cavity adapted to retain the keyboard against dislodgement toward the rear or to either side. The lateral extent of the upper armrest surface between the front parts of the side edges of the member is sufficient to support a computer mouse laterally outwardly of at least one of the forearms of the operator.

A keyboard stand embodying the present invention is mounted on a suitable support, such as the typewriter return of a desk, legs or a pedestal, or an adjustable arm. In all cases, the height of the chair and of the stand should be such that the operator, seated in a comfortable posture, can rest his or her forearms on the armrest surface, the upper arms being comfortably positioned to the sides of the upper torso in a relatively relaxed state. The proximal portions of the palms of the hands rest on the front edges of the armrest portion of the stand, and the fingers extend out over the keyboard. In this position, the operator does not have to hold his or her forearms up to keep the hands over the keyboard, the arms, instead, being supported by the armrest surface. The shoulder and arm muscles are virtually completely relaxed, and there are no stresses imposed on the tendons and other tissues associated with those muscles. It is believed, moreover, that by eliminating the stresses on the shoulders and arms, the stresses in the wrist and fingers are considerably reduced.

For a better understanding of the invention, reference may be made to the following description of an exemplary embodiment of the invention, taken in conjunction with the accompanying drawings.

DESCRIPTION OF THE EMBODIMENT

Figure 1:
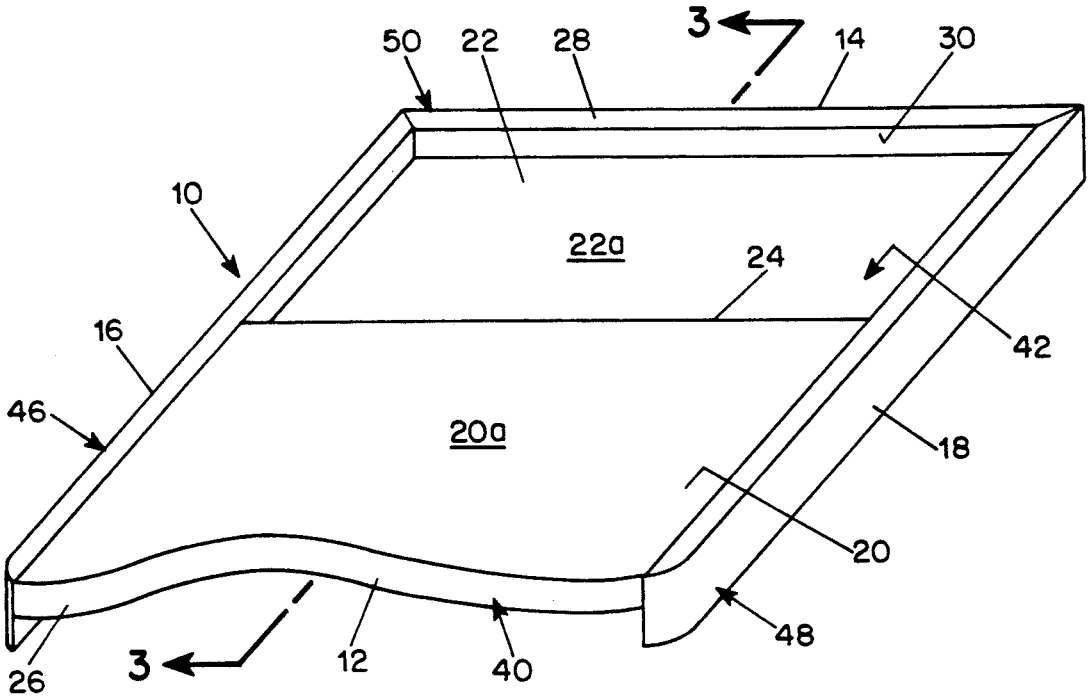
FIG. 1 is a perspective view of the embodiment.
Figure 3:
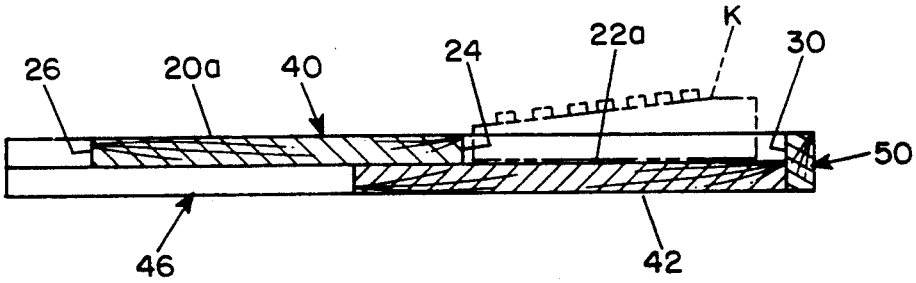
FIG. 3 is a side cross-sectional view of the embodiment, taken along the lines 3—3 of FIG. 1.

Referring first to FIG. 1, the embodiment is a plate-like member 10 having a front edge 12, a rear edge 14, and side edges 16 and 18. The front portion of the member is an armrest portion 20 having an upper armrest surface **20*a* of a size and shape such as to be adapted to support both forearms of a keyboard operator when the operator's hands are positioned to operate a keyboard K (FIG. 3). The upper armrest surface 20*a* is bounded by the front edge 12 and front parts of the side edges 16** and 18 of the member. The rear portion of the member is a keyboard-supporting portion 22 having an upper keyboard-supporting surface 22*a* of a size and shape such as to be adapted to support a keyboard, the upper keyboard-supporting surface being bounded by the rear edge 14 and rear parts of the side edges 16 and 18 of the member and adjoining the upper armrest portion along a juncture at a location intermediate the front and rear edges of the member. The keyboard-supporting surface 22*a* is recessed below the armrest surface 20*a* such the frontmost part of the housing of the keyboard does not extend substantially above the armrest surface. There is a shoulder 24 at the juncture of the portions 20 and 22 that is adapted to be engaged by the front edge of the keyboard housing.

The front edge of the member 10 has a notched part 26 that is shaped and positioned to receive an operator's lower front torso, whereby the operator's elbows may be positioned generally laterally of the lower torso with the upper arms in generally relaxed positions along the sides of the upper torso. The upper keyboard-supporting surface 22*a* of the member is bounded by an upstanding flange 28 along the sides and the rear that define, together with the shoulder 24, a cavity 30 adapted to retain the keyboard against dislodgement toward the rear or to either side. The cavity is, of course, large enough to accept the keyboard in nested relation and may be slightly oversize. The lateral extent of the upper armrest surface between the front parts of the side edges 16 and 18 of the member is sufficient to support a computer mouse laterally outwardly of at least one of the forearms of the operator. In the illustrated embodiment, the extra space for the mouse is on the right side which makes it suitable for a right-handed operator. For left-handed operators, the space for the mouse can be on the left side. The notched part 26 is offset from the center by an amount equal to the width of the space for the mouse.

The member 10 may be made of any suitable durable, rigid material, such as wood, metal or plastic. It may have a covering and may be padded for comfort. While the armrest surface may be contoured to provide shallow depressions for the operator's forearms, that is by no means necessary—indeed, it may be best to have flat surface, because different people will find that different arm positions are more comfortable than others, particularly insofar as the spacing between the elbows and the torso is concerned. Moreover, a given operator may from time to time change his or her arm position. A lack of contouring increases the freedom for assuming different arm positions.

Figure 2:
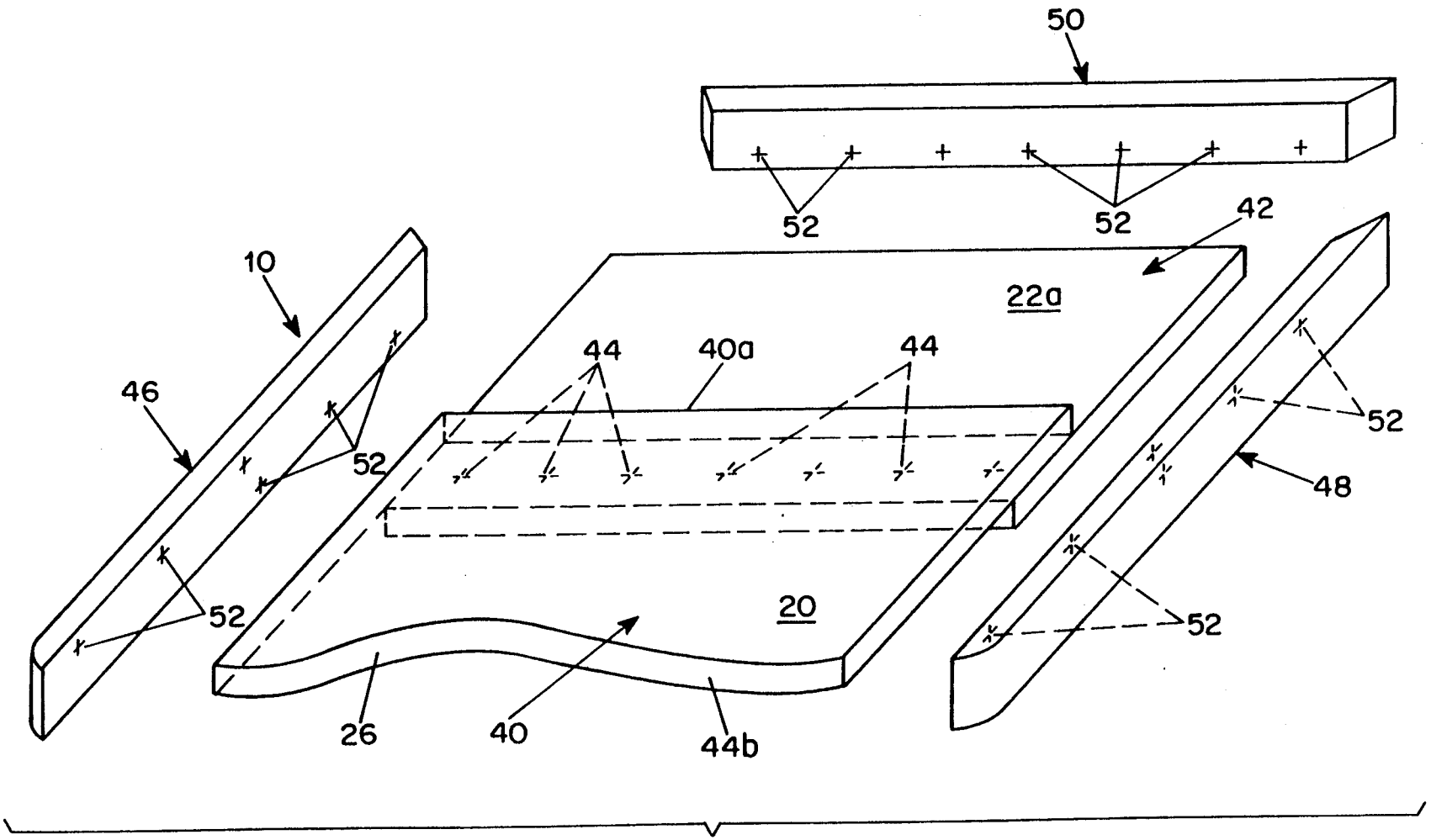
FIG. 2 is an exploded perspective view of the embodiment.

The embodiment is fabricated from wood, such as oak or some other hardwood. Hardwoods are preferred for durability. Wood is attractive, durable, relatively inexpensive and easily cut and shaped. As shown in FIG. 2, two pieces 40 and 42 are cut from ¾ inch thick solid oak stock to equal lengths and suitable widths from front to back of the assembled pieces to provide the armrest portion and keyboard-supporting portion, respectively. The notch 26 is cut in the front edge of the piece 40. The piece 42 is made wide enough to provide an overlap with the piece 40. The two pieces are then joined in overlapping relation (see FIG. 2) by gluing and with dowels or screws at locations 44. The rear edge 40*a* of the piece 40 provides the shoulder at the juncture of the armrest portion with the keyboard-supporting portion. It is desirable to round off the corners of the front edge 44*b* of the front piece 40 using a router before the next steps of the assembly process.

As shown in FIG. 2, two side pieces 46 and 48 and a rear piece 50 are fabricated from ¾ inch thick oak stock. These pieces are 1½ inch wide and are miter cut at the junctures of the side pieces with the rear piece. The front ends of the side pieces are shaped to a quarter round. The side pieces and end pieces are then fastened by gluing and by dowels or screws at locations 52 to the side edges of the pieces 40 and 42 and the rear edge of the piece 42. The upper edges of the side and rear pieces 46, 48 and 50 are flush with the upper surface of the front piece 40. The portions of the side and rear edge pieces 46, 48 and 50 that extend up from the upper surface of the rear piece 42 form the flange 28.

We claim:

1. A keyboard stand comprising substantially rigid plate-like member having a front edge, a rear edge, and side edges, said front edge having a center midway between said side edges and a notched part offset from said center, said notched part shaped and positioned to receive an operator's lower front torso, an upper armrest surface of a size and shape such as to be adapted to support substantially all of but forearms of a keyboard operator from the elbows to the wrists when the operator's hands are positioned to operate a keyboard, the upper armrest surface being bounded by the front edge and front parts of the side edges of the member, and an upper keyboard-supporting surface of a size and shape such as to be adapted to support a keyboard, the upper keyboard-supporting surface being bounded by the rear edge and rear parts of the side edges of the member and adjoining the upper armrest surface along a juncture at a location intermediate the front and rear edges of the member, the upper keyboard-supporting surface being recessed below the upper armrest surface such that the frontmost part of the housing of the keyboard does not extend substantially above the upper armrest surface and the member having a shoulder at said juncture adapted to be engaged by the front edge of the keyboard housing.

2. A keyboard stand according to claim 1 wherein the upper keyboard-supporting surface of the member is bounded by an upstanding flange defining, together with the shoulder at the juncture between the keyboard-supporting surface and the armrest surface, a cavity adapted to retain the keyboard against dislodgement toward the rear or to either side.

3. A keyboard stand according to claim 1 wherein the lateral extent of the upper armrest surface between the front parts of the side edges of the member is sufficient to support a computer mouse laterally outwardly of at least one of the forearms of the operator.

* * * * *